United States Patent [19]

Grass

[11] Patent Number: 4,839,940

[45] Date of Patent: Jun. 20, 1989

[54] RAPIDCY MOUNTABLE FURNITURE HINGE WITH SNAP CLOSURE

[75] Inventor: Alfred Grass, Höchst, Austria

[73] Assignee: Alfred Grass Ges.m.b.H. Metallwarenfabrik, A-6973 Hoechst/Vlbg., Austria

[21] Appl. No.: 120,907

[22] Filed: Nov. 16, 1987

[30] Foreign Application Priority Data

Nov. 17, 1986 [DE] Fed. Rep. of Germany ..... 3639276

[51] Int. Cl.[4] ..... E05D 7/12

[52] U.S. Cl. ..... 16/258; 16/382; 16/DIG. 43

[58] Field of Search ..... 16/238, 240, 245, 246, 16/250, 251, 258, 370, 382, DIG. 43

[56] References Cited

U.S. PATENT DOCUMENTS 4,430,771 2/1984 Salice ..... 16/258 X

FOREIGN PATENT DOCUMENTS 8602402 4/1986 European Pat. Off. ..... 16/238
2806958 2/1978 Fed. Rep. of Germany .
3119571 12/1982 Fed. Rep. of Germany ..... 16/258
8616146 6/1986 Fed. Rep. of Germany .

*Primary Examiner*—Fred A. Silverberg

[57] ABSTRACT

The furniture hinge with snap closure has a housing that can be sunk in a recess of a door part and articulates with a hinge arm through at least one joint plate, the hinge arm being detachably connectable with a mounting plate fastened to the furniture part by two or more fastening and adjusting screws. The connection between the hinge arm and the mounting plate on the furniture side is designed as a snap closure with a spring-loaded rotary slider pivoting at the end of the furniture-side part of the hinge away from the door. The furniture-side mounting plate has a two-part design, the bottom section bearing the spring-loaded rotary slider and the top section being connected with the hinge arm. Form-fitting connections are arranged between the top section and the bottom section of the mounting plate that center automatically in both the direction of the longitudinal axis of the hinge and in the direction vertical thereto when the two sections are guided toward each other in order to close the hinge.

6 Claims, 10 Drawing Sheets

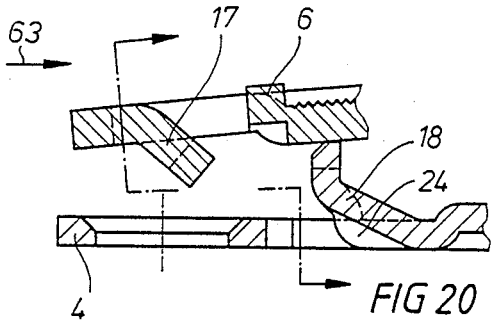
FIG 20
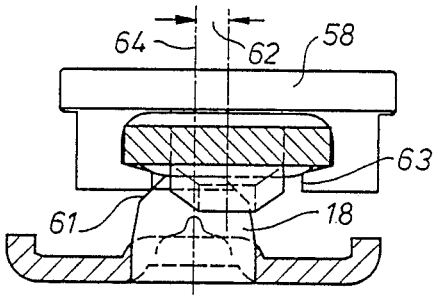
FIG 21
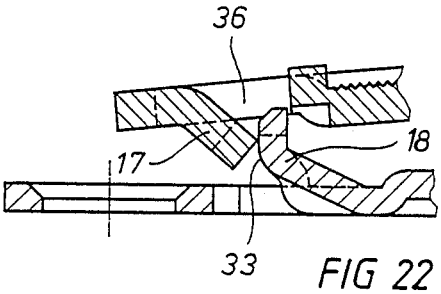
FIG 22
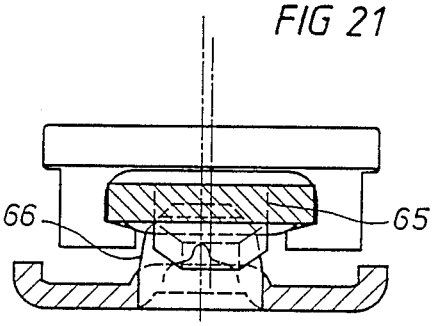
FIG 23
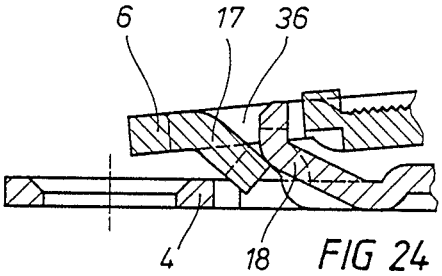
FIG 24
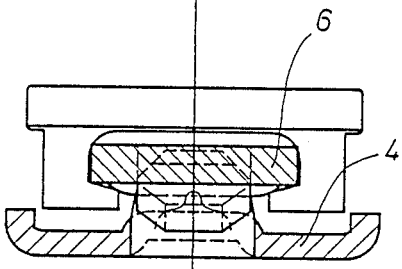
FIG 25
FIG 26
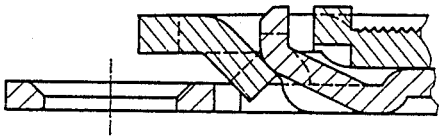
FIG 27
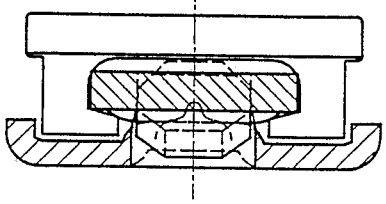

RAPIDCY MOUNTABLE FURNITURE HINGE WITH SNAP CLOSURE

BACKGROUND OF THE INVENTION (1) Field of the Invention The invention relates to a furniture inge in accordance with the classifying portion of claim 1.

(2) Description of the Prior Art A furniture hinge of this type has been disclosed, for example, with the subject-matter of German Registered Utility Model 86 16 146 or German Patent Specification 28 06 958A1.

These known types of hinges are relatively expensive to design, however, because the spring-loaded rotary slider effecting snap closure is arranged indirectly or directly on the hinge arm itself and conversion of conventional hinges without snap closure is not possible. Use must therefore be made of newly designed hinges with the rotary slider on the hinge arm.

Furthermore, the publications do not deal with the problems of achieving the goal of rapid assembly of a door part with a furniture part.

This type of door part generally has a parallel arrangement of two or three hinges and the hinges must be connected in sequence with the plate securely fastened on the furniture part by actuating the snap closure, which is not readily possible with the hinges known up to now.

For example, if two hinges have already been securely fastened by actuating the snap closure, it is possible only with difficulty to close the third hinge as well by actuating the snap closure, because the forces acting on this hinge due to the weight of the door are so great that this hinge can be actuated only with difficulty.

Up to now, therefore, it was possible only with great effort to close one of a number of hinges mounted in parallel on a door by actuating the snap closure once the others were already closed.

The objective of the invention is thus to develop a furniture hinge with snap closure of the type mentioned in the beginning which will facilitate rapid mounting of a hinge even if other hinges arranged parallel thereto have already been fastened.

SUMMARY

This objective is met by the invention in that the mounting plate on the furniture side is designed to be in two parts and consists of a mounting plate bottom section fastened to the furniture part and a mounting plate top section arranged directly or indirectly on the hinge arm, in that the snap closure is arranged between the top section and the bottom section, and in that the top section and the bottom section are automatically centered in both the direction of the longitudinal axis of the hinge and the direction vertical thereto through form-fitting connections arranged between the two sections.

An essential feature of this invention, therefore, is a mounting plate arranged on the furrniture side and made of two sections, whereby it is important that the snap closure be arranged between the top section and the bottom section of this two part mounting plate.

This means that conventional hinges (without snap closure) can now be converted into hinges with snap closures without changing fundamental parts thereof.

According to the present invention, one need only use the invented two-part mounting plate instead of a conventional one-part mounting plate with the rotary slider being arranged at the end of the two-part mounting plate away from the door.

The invention thus avoids arranging the rotary slider itself on the hinge arm so as to avoid complicated reconstruction of the hinge arm.

A further essential feature of the invention is the arrangement between the top section and the bottom section of this two-part mounting plate of form-fitting connections in the effect centering during assembly of both sections in the direction of the longitudinal axis of the hinge and in the direction vertical thereto.

There can be considerable variation in the design of such form-fitting connections. The only important thing is to design the form-fitting connections with centering arrangements so that, when the hinge is mounted, the top section of the mounting plate can be guided toward the bottom section of the mounting plate and that these two section will be automatically centered with respect to each other on engagement of the form-fitting connection to be described later.

A feature of the present invention is that, even when hinges, for example, the top and bottom ones, are securely fastened, it is still possible to snap on a middle hinge, because the engaging tangs with the associated recesses are provided with wedge surfaces and bevels so that either the middle hinge is locked downward by mounting and guiding the mounting plate top section onto the mounting plate bottom section or snap-on is carried out in the upward direction.

It is important for all assembly procedures that the other hinges already securely fastened still be able to give a few tenths of a millimeter so that force can be applied to the door to gain enough clearance so that the middle hinge not yet engaged can then be engaged through the wedge surfaces and bevels provided in accordance with the invention.

This force used to shift the already securely mounted hinges is not applied directly to the door but rather through the hinge not yet snapped in because the engaging wedge surfaces and bevels are in alignment between the top and bottom sections of the mounting plate so that suitable shifting forces are applied to the door and make the already mounted hinges give a few tenths of a millimeter so that the hinge not yet mounted will have enough clearance for snapping into position.

The subject matter of the present invention as indicated not only by the subject matter of the individual patent claims but also by a combination of the individual patent claims with each other. All data and features disclosed in the documents, particularly the spatial configurations represented in the drawings, are claimed as essential to the invention to the extent that they are novel compared to the prior art either individually or in combination.

The invention is explained in more detail below by means of drawings that represent only one example embodiment. The drawings and their description indicate further features essential to the invention as well as the benefits of the invention.

BRIEF DESCRIPTION OF THE DRAWINGS

FIGS. 20 to 27: Same section as in FIG. 18 through the form-fitting connection near the door between the top section and the bottom section in different motion phases for the assembly case where the top section is moved from the end near the door toward the end away from the door to be placed on the bottom section.

DESCRIPTION OF THE PREFERRED EMBODIMENT

Figure 1:
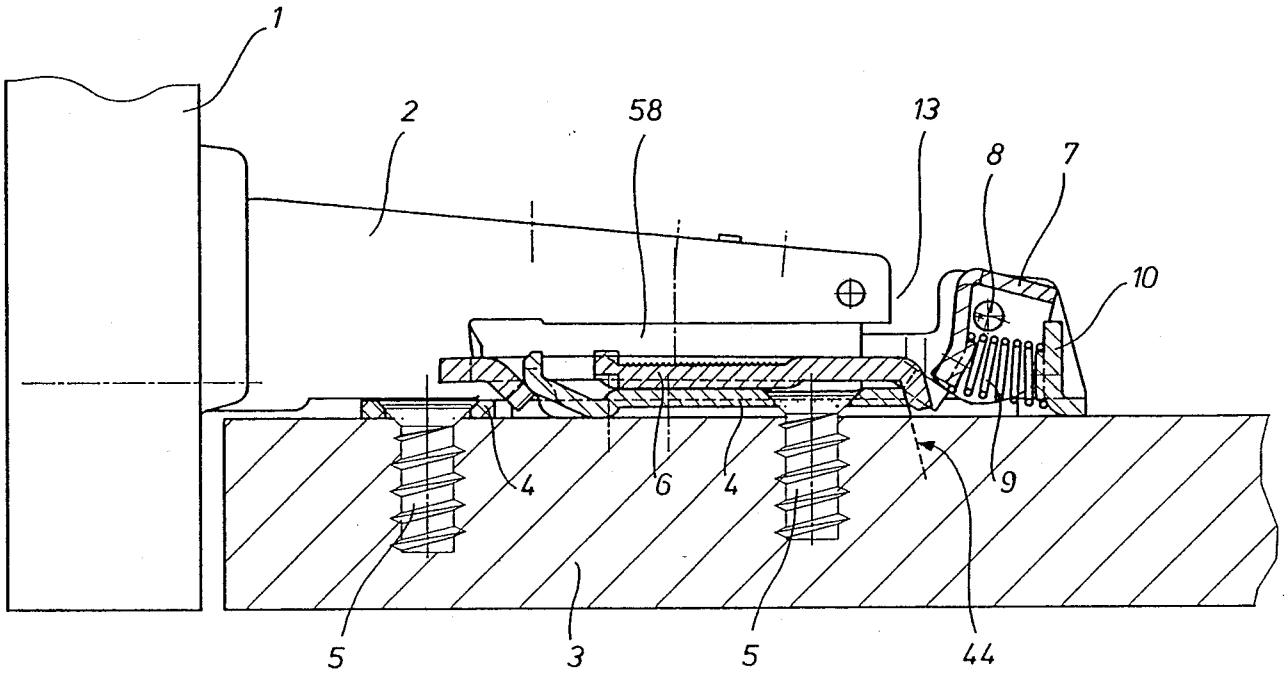
FIG. 1: Section through the mounting plate of a hinge according to the invention in the closed condition.

FIG. 1 shows a hinge according to the invention with the closure connection still to be described, whereby a hinge arm 2 is attached to a door part 1 in a way that is known per se, and a mounting plate bottom section 4 is fastened to a furniture part 3 by means of fastening screws 5, whereby the mounting plate bottom section has an associated mounting plate top section 6, which is connected in a way that is known per se with the hinge arm 2 with adjusting and intermediate plates that are not represented in detail.

The connection of these parts can be derived, for example, from German Patent Applications 36 24 237.3 and 36 07 406.3 filed by the same applicant.

It is important for the present invention that the mounting plate bottom section 4 and the mounting plate top section 6 be joined in the special way described below.

A spring-loaded rotary slider 7 is mounted to pivot on the axis 8 at the end of the mounting plate bottom section 4 away from the door, the spring 9 being braced by a tang 10 of the mounting plate bottom section 4.

Figure 2:
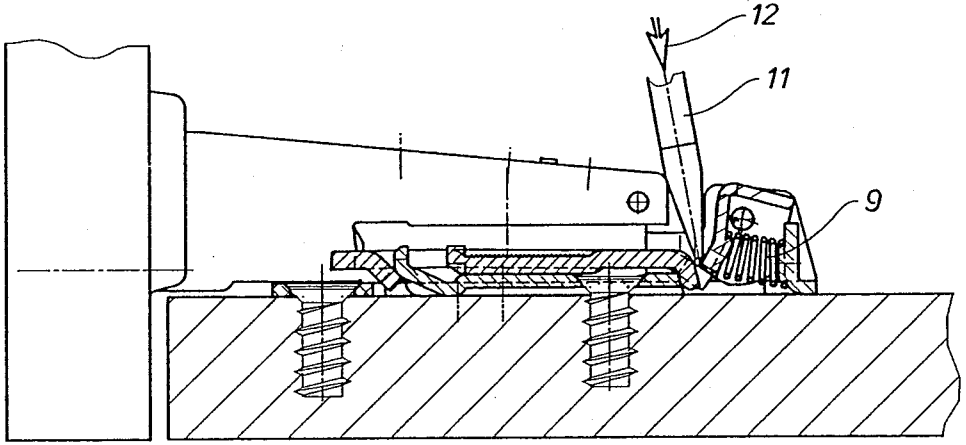
FIG. 2: The same hinge as in FIG. 1 with representation of the opening by means of a tool in the first phase of motion.
Figure 3:
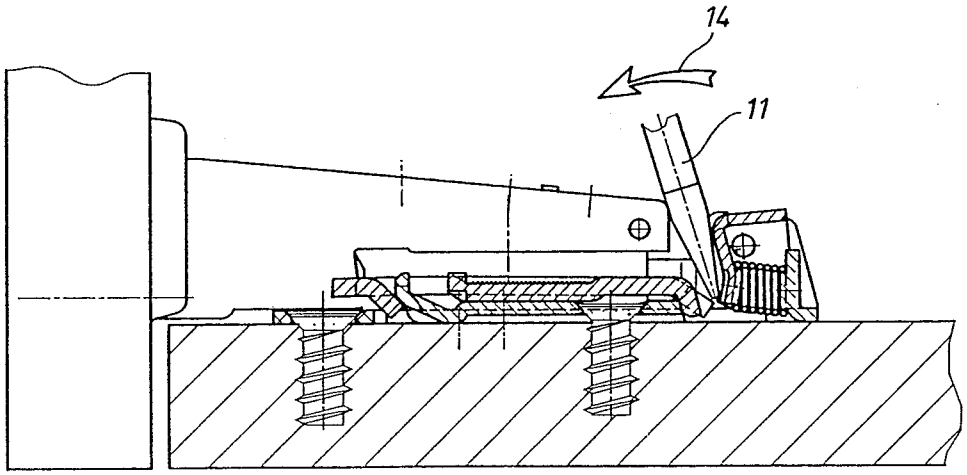
FIG. 3: Same representation as FIG. 2 with representation of the opening in the second phase of motion.

Thus, the rotary slider 7 is always spring-loaded in the closing position of the connection between the mounting plate bottom section 4 and the mounting plate top section 6. FIGS. 2 and 3 show the same hinge according to FIG. 1 and it can be seen that it is possible to initiate the closure connection by means of a tool 11 introduced in the direction of the arrow 12 in the space 13 between the end of the hinge frame arm 2 away from the door and the mounting plate bottom section in that the tool 11 is pressed on the front side of the rotary slider 7 and pivoted in the direction of the arrow 14 against the force of the spring 9. In this way, it is possible to break the closure connection between the mounting plate bottom section 4 and the top section 6 without the need for unscrewing a screw while ensuring that this closure connection can only be carried out with a tool, that is, unintentional initiation of the closure connection is thereby avoided in any case.

Figure 4:
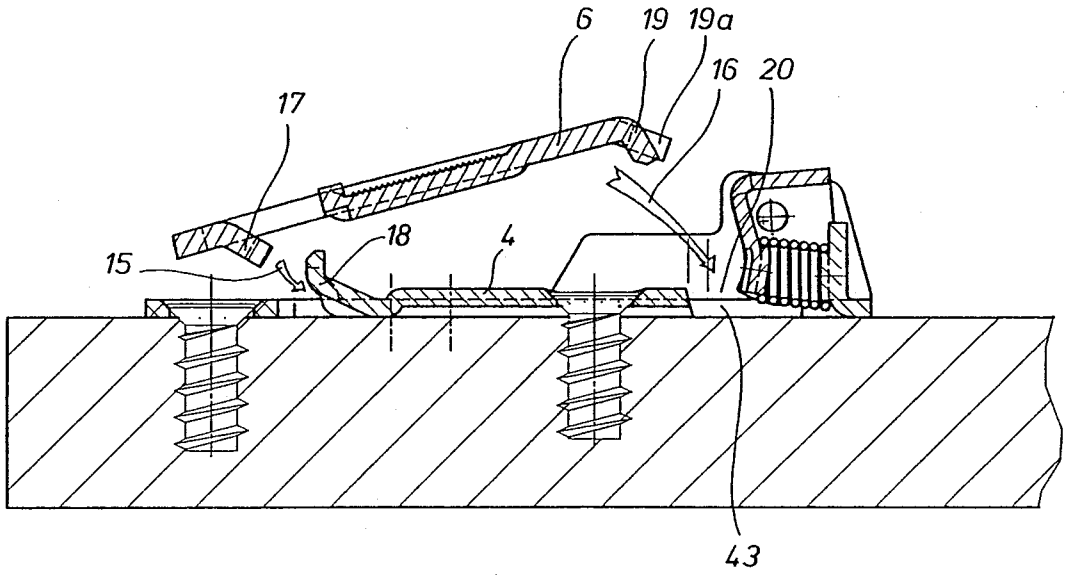
FIG. 4: Section through the two-part mounting plate with the top section away from the bottom section and to be conveyed toward the bottom section.

FIG. 4 then shows how the mounting plate top section 6 is guided onto the mounting plate bottom section 4, and it can be seen that the end of the mounting plate top section 6 near the door is first pushed with a tang 17 extending from the bottom side under a tang 18 extending upward from the top side of the bottom section 4 while at the same time a tang 19 arranged at the end away from the door is introduced into an associated opening 20 on the bottom section 4.

The tang 19 on the top section 6 has a tang 19*a* extending forward from its plane provided for interlocking with associated wedge surfaces on the rotary slider 7. There are two lateral tangs 19*a* that define a middle tang 19 between them as will be explained later in detail. It is important to point out for the representation in FIG. 4 that the sequence of snapping the top section 6 onto the bottom section 4 is not necessarily such that the end of the top section 6 near the door is first mounted in the direction of the arrow 15 on the bottom section 4 and only then the end of the top section 6 away from the door is mounted in the direction of the arrow 16 on the bottom section. For example, when two hinges have already been securely fastened to a door and the third hinge is to be snapped on, the mounting sequence first in the direction of the arrow 15 and then in the direction of the arrow 16 is not possible. In this case, the mounting plate top section 6 must be mounted with its surface approximately parallel to the surface of the bottom section 4. That is, the end away from the door and the end near the door are mounted approximately parallel to each other, or provision is even made so that the end away from the door is first mounted in the direction of the arrow 16 and then the end near the door can be mounted in the direction of the arrow 15.

Using the later drawings, it is explained how this assembly case can also be dealt with by means of the invented guide surfaces between the assoicated tangs, 17, 19 and between the tang 19 and the opening 20. This cannot be accomplished with any of the known hinges.

Figure 5:
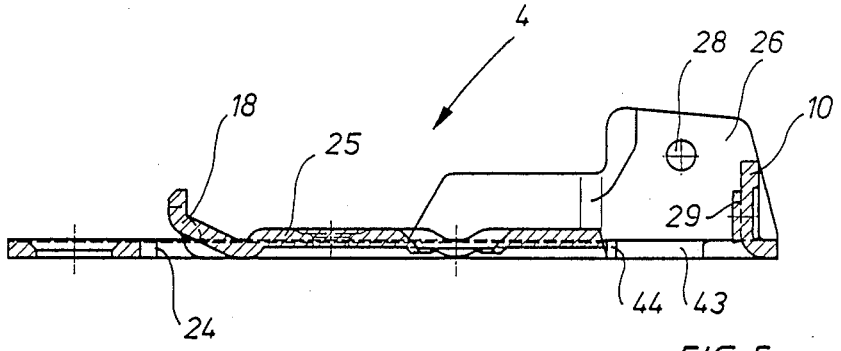
FIG. 5: Longitudinal section through the bottom section in accordance with the line A—A in FIG. 7.
Figure 7:
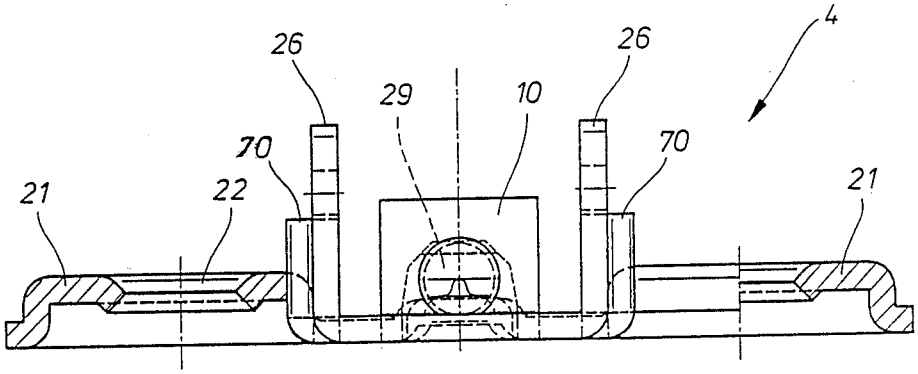
FIG. 7: Section in accordance with the line B—B in FIG. 6.

FIG. 5 shows the section through the mounting plate bottom section 4 corresponding to the section A—A in FIG. 7. The following explanations apply here.

The mounting plate bottom section 4 consists of an elongated, T-shaped piece of sheet metal that has two legs 21 extending from the center longitudinal plane with suitable bores 22 for inserting the fastening screws 5.

Two spaced bores 22 are also provided in alignment along the center longitudinal plane for insertion of the fastening screws 5.

The T-shaped profile of the mounting plate bottom section according to FIG. 7 is not mandatory. It is possible in an initial embodiment for the legs 21 to be eliminated entirely with provision of only an elongated piece of sheet metal with the two aligned bores 22.

Another embodiment of the invention provides for elimination of the bores 22 in alignment on the center longitudinal axis, providing only a T-shaped piece with the two bores 22 in the two legs 21 lying opposite each other.

In the area of the center longitudinal axis, the tang 18 is bent out of the plane of the bottom section 4 and reinforced with a crease 23 to make this tang resistant to further bending.

The tang 18 defines an opening 24 in the plane of the bottom section 4 in the direction of the end near the door.

A U-shaped elevation 25 is arranged in the area of the center longitudinal axis in the direction of the end of the bottom section 4 away from the door to serve as a guide surface for as associated opposing elevation in the mounting plate top section 6. The two sections 4,6 lie with these guide surfaces flush on one another so that force can be transferred through these guide surfaces.

The bottom section 4 also has two opposing lateral legs 26 forming a receiving chamber 27 between them in which the spring-loaded rotary slider 7 pivots. Bores 28 aligned opposite each other are arranged in the legs 26 through which a shaft passes. The rotary slider 7 pivots on this shaft.

Figure 8:
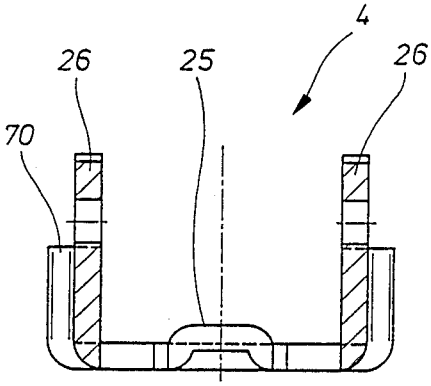
FIG. 8: Section in accordance wtih the line E—E in FIG. 5.
Figure 9:
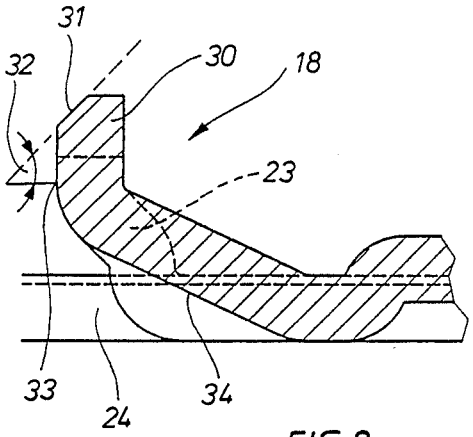
FIG. 9: Detail V according to FIG. 5.

Edges 70 are formed at the end of the legs 26 away from the door according to FIG. 8 and 9 which stop the rotary slider 7 in its spring-loaded open position. On opening, the rotary slider runs with its surfaces 69 toward the edges 70 and stops there with frictional contact until this frictional contact is overcome manually or by means of a tool whereupon the rotary slider is forced back to the closing position by the spring 9. The advantage of this locking in the open position for mounting a number of hinges arranged in parallel on a door is that the rotary slider no longer has to be held by hand in the open position when the other hinges are locked in place. Once the desired closure position has been found, the rotary slider is released from the open position by hand or with a tool and it then automatically effects closure with the top section 6. The end of the mounting plate bottom section 4 away from the door is formed by a tang 10 projecting upward from the surface that forms a counter-bearing for the spring 9 and has a short extension 29 that centers the spring 9 thereon. At the same time, the tang 10 covers the rear site of the rotary slider 7 that is actually open toward the end away from the door so that one cannot put one's finger into the receiving chamber 27. This avoids any finger injuries and prevents unintentional actuation in this way of the rotary slider. The raised edges 70 are formed on the bottom section at the side of these tangs 10.

Figure 6:
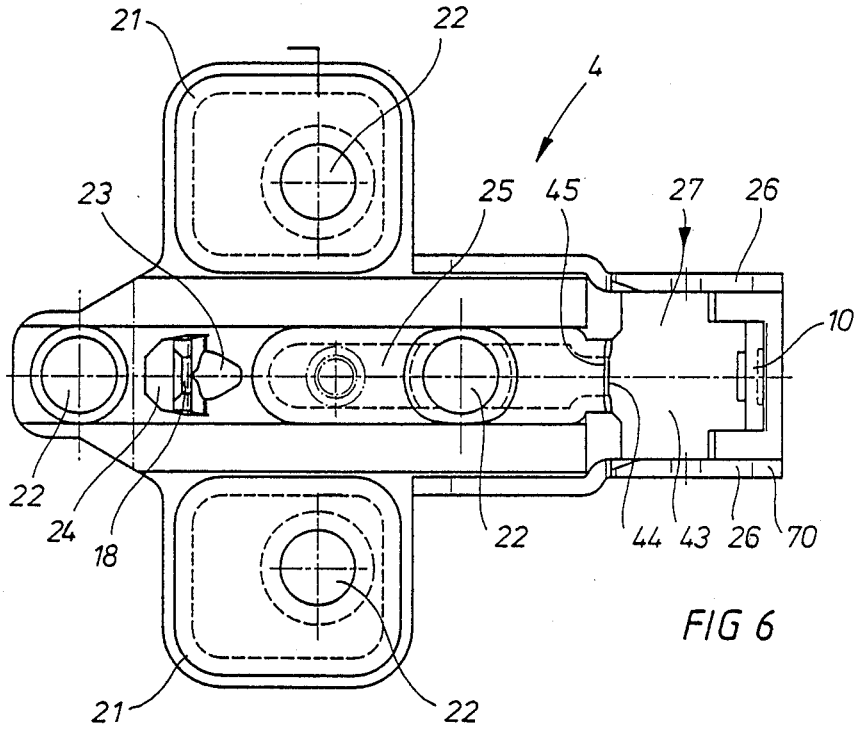
FIG. 6: Plan view of the bottom section according to FIG. 5.

FIG. 7 shows the section in accordance wtih the line B—B in FIG. 6, while FIG. 8 shows the section in accordance with the line E—E in FIG. 5 through the mounting plate bottom section 4. The section B—B goes through the two bores in the legs 21 opposite each other and one can see the legs 26 opposite each other with the receiving chamber 27 in between them as well as the tangs 10 with the centering 29 for the spring 9.

FIG. 8 shows the section through the legs 26 lying opposite each other with a representation of the elevation 25 that extends over the base of the bottom section 4.

FIG. 9 shows the tang 18 with the opening 24. The following further features can be seen.

The tang 18 has a verge-shaped tang head 30 with an upper initial beveled wedge surface 31. It is important that this wedge surface has an angle 32 with widening in the direction of the end away from the door.

Next to the wedge surface 31 is a rounded surface that changes into a straight surface at the underside of the tang.

Figure 11:
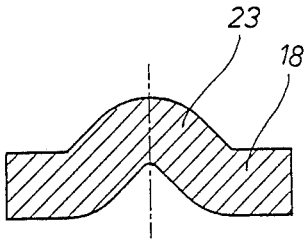
FIG. 11: Section in accordance with the line D—D in FIG. 9.

The tang 18 according to FIG. 6, 9 and 11 has the crease 23 at its top that serves to increase the resistance of the tang 18 to bending.

Figure 12:
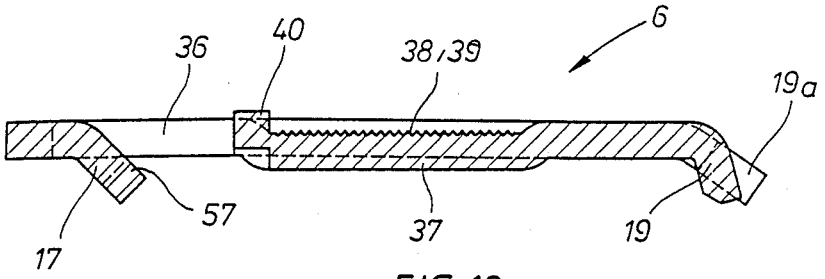
FIG. 12: Section in accordance with the line A—A in FIG. 14 through the top section.
Figure 13:
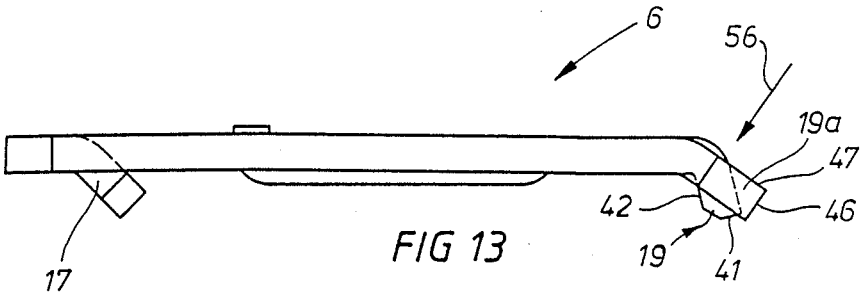
FIG. 13: Side view of the top section.
Figure 14:
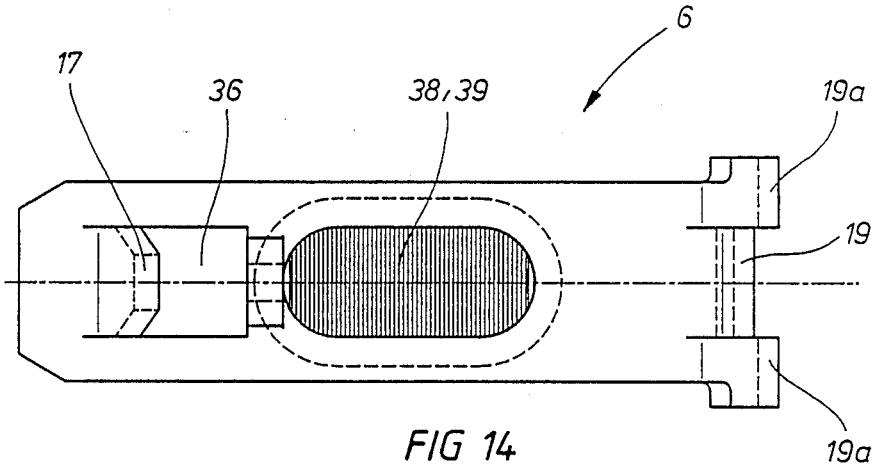
FIG. 14: Plan view of the top section

FIG. 12 to 14 show different views of the mounting plate top section 6.

FIG. 12 is the section in accordance wtih the line A—A of FIG. 14. FIG. 13 is a side view and FIG. 14 is a plan view of the mounting plate top section 6.

The mounting plate top section 6 consists of an elongated strip of sheet metal with a downward extending tang 17 pressed out of the material of the mounting plate top section thus defining an opening 36.

The underside of the the mounting pate top section 6 has an elevation 37 associated with the elevation 25 on the mounting plate bottom section 4 with the two elevations 25, 37 lying flush against one another in the assembled condition.

Arranged opposite the elevation 37 is a depression 38 provided with corrugations 39 which serves to receive the bolt-side end of the depth adjustment screw not shown.

The corrugation 39 serves as an additional means to stop the depth adjustment screw in the tightened condition.

A raised stop is provided at the end of the depression 38 near to the door, which prevents withdrawal of the depth adjustment screw with its bolt-side end in semi-mounted condition from the depression 38 in the direction of the center longitudinal axis of the hinge, which in this case would allow the door to fall off.

Arranged at the end of the top section 6 away from the door is the further tang 19 beyond which two lateral tangs 19 a extend. The tang 19 has a wedge surface 41 directed downward at an angle, this angle to the horizontal plane of the upper section decreasing toward the end away from the door.

A further wedge surface 42 is provided in the angle to the wedge surface 41 and is used for bracing the top section 6 with the bottom section 4 at the end away from the door. According to FIG. 5, an opening 43 is formed in the area of the bottom section 4 at the end away from the door, which is engaged by the leg 19 of the top section. The face boundary of this opening 43 ((44 in original)) is provided with a wedge surface 44 lying obliquely in the angle to the end away from the door, its angle decreasing toward the end away from the door.

The wedge surface 42 on the middle tang 19 of the top section 6 thus lies on this wedge surface 44 (in the area of the opening 43 of the bottom section) when the two sections 4,6 are braced with each other.

The other wedge surface 41 in the area of the tang 19 serves to facilitate introduction of the tang 19 into the opening 43 because, when these two sections are assembled, the wedge surface 41 first lies on the top side 45 of the wedge surface 44 and then, due to the slip of the wedge surface 41 at the top side 45, the wedge surface 42 is moved to the wedge surface 44 in the area of the opening 43 and the two sections lie against each other in a force-locked and flush condition.

This association of the wedge surfaces is important when, as represented in FIG. 4, the tang 17 is first hooked into the tang 18 in the direction of the arrow 15 at the end near the door and only then is the tang 19 introduced in the direction of the arrow 16 into the opening 43.

The two outer tangs 19a associated with the tang 19 and extending symmetrically are used to actuate the rotary slider 7 and for applying closing force at the end away from the door.

For this purpose, the two tangs 19a according to FIG. 13 have forward beveled faces 46 joined vertically by a surface 47. It is important, however, that the surface 47 forms an angle in its plane in the direction of the end away from the door to achieve automatic locking of the rotary slider in the closed position.

Figure 15:
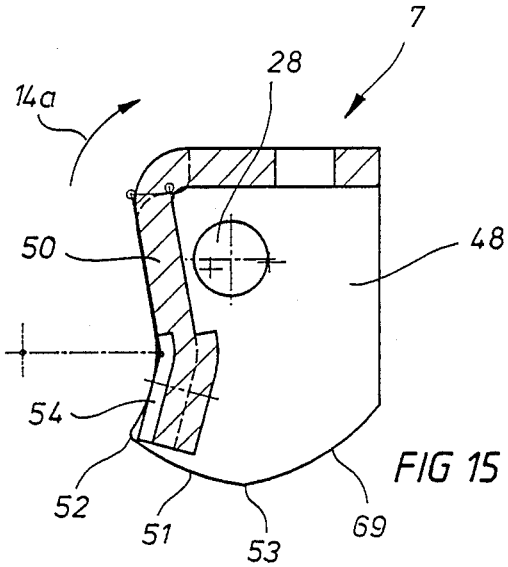
FIG. 15: Section through the rotary slider in accordance with the line A—A in FIG. 17.
Figure 16:
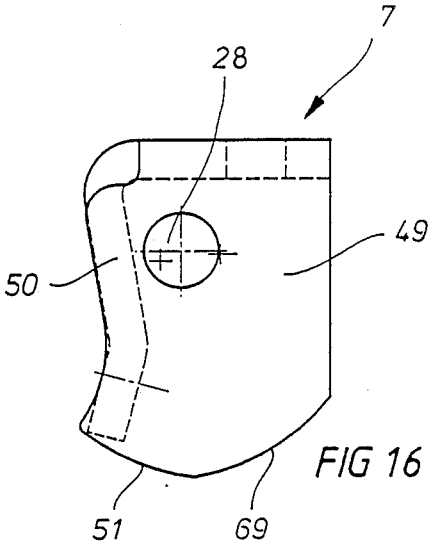
FIG. 16: View Z of the rotary slider in accordance with FIG. 17.
Figure 17:
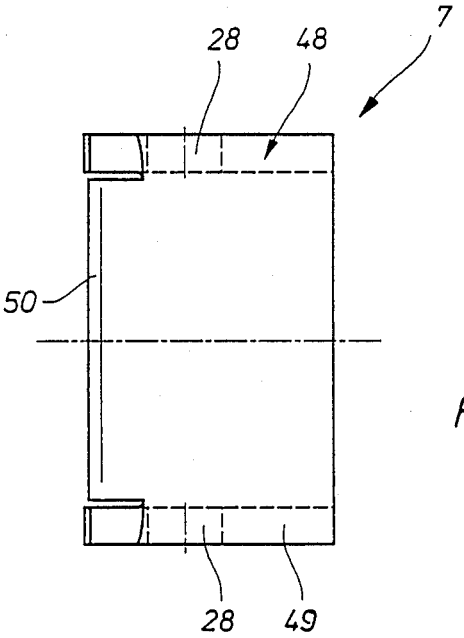
FIG. 17: Plan view of the rotary slider.

In this respect, the rotary slider 7 is shown in more detail in FIG. 15 to 17. The rotary slider consists of a U-shaped part with two lateral legs 48, 49 and a face part 50 lying in between.

The two legs 48, 49 have opposing bores 28 to receive the shaft 8.

The bottom side of the legs 48, 49 is provided with excentric surfaces 51 that are excentric with respect to the center of the bores 28. It is important that the forward edge 52 lies closer to the center of the bore 28 than the rear edge 53 of this excentric surface 51. A crease 54 is forced out of the material of the face 50 at the forward side of the face to form a round nub 55 on the inner side of the face 50 that is used to center the spring 9.

The surfaces 69 next to the excentric surfaces 51 in the direction of the end away from the door are also excentric with respect to the center of the shaft 8 so that these surfaces 69 together with the edges 70 on the bottom section (FIG. 8, 9) form a self-locking stop in the open position of the rotary slider 7.

According to the representation in FIG. 2 and 3, the tool 11 is then pressed on the area of the crease 54 or around the crease 54 in order to bring the rotary slider 7 against the force of the spring 9 in the direction of the arrow 14 into the open position, whereby the surfaces 69 run on the edges 70 of the bottom section 4 and hold the rotary slider in the open position.

The slope of the nub 55 is adjusted so that the plane of the nub is relatively vertical to the longitudinal axis of the spring 9.

In the engaged condition (closing condition), the excentric surface 51 then presses on the two surfaces 47 in the area of the tangs 19*a* resulting in a bracing since the seating becomes more stable as the rotary slider 7 is turned in the direction of the arrow 14a because the rear edge 53 ofthe excentric surface is farther away from the center of the bores 28 than the forward edge 52.

It is important that the excentric surfaces 51 on the legs 48, 49 of the rotary slider 7 exercise a force in the direction of the arrow 56 on the surface 47 of the tangs 19*a*.

Figure 19:
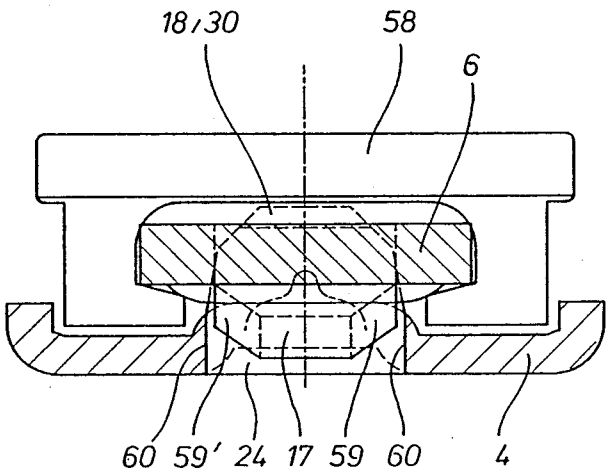
FIG. 19: Section in accordance with the line IXX-IXX in FIG. 18.
Figure 18:
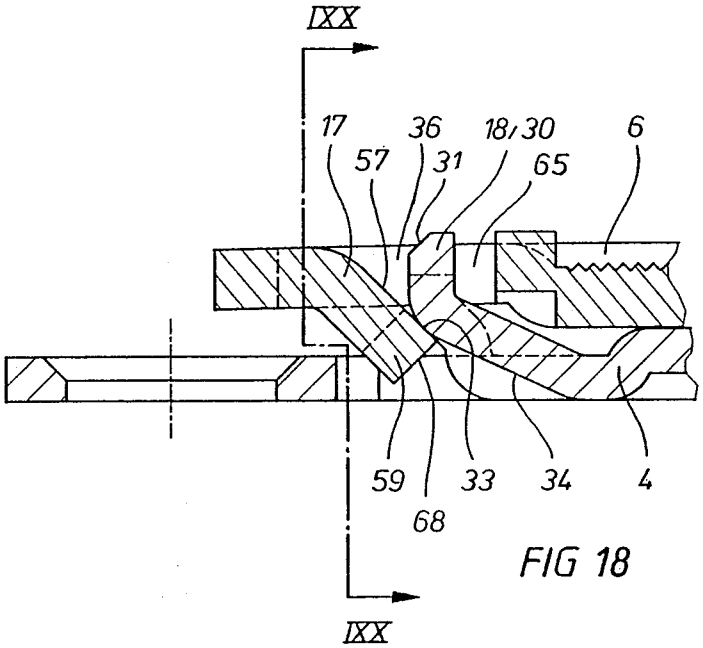
FIG. 18: Detail section through the form-fitting connection near the door between the top section and the bottom section.
Figure 28:
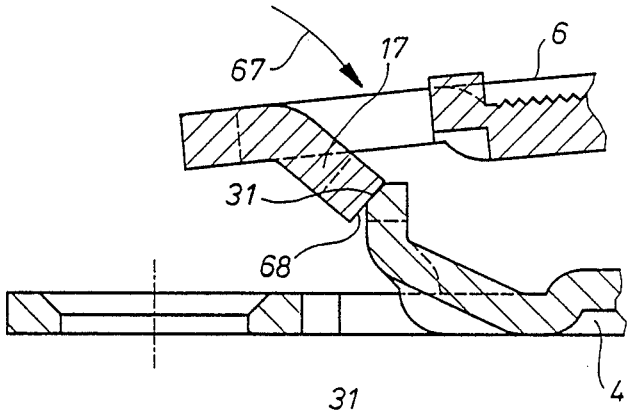
FIGS. 28 to 31: Same representation as in FIG. 20 to 27 for the assembly case where the top section is placed approximately vertically on the bottom section.

The wedge surface 42 on the tang 19 thus slides along the associated wedge surface 44 of the bottom section 4 and, at the same time, the tang 17 is drawn with its wedge surface 57 (FIG. 12) under the tang 18 of the bottom section, as will be explained in more detail with the following figures. FIG. 18 shows an enlarged longitudinal section through the part near the door of the connection between the top section and the bottom section, while FIG. 19 shows the section in accordance with the line XX—XX in FIG. 18.

It can be seen here that the tang 17 extending downward from the top section 6 lies in the mounted condition with its angled wedge surface 57 on the rounded surface 33 of the tang 18. when these two parts are connected, there will be a relative displacement between the wedge surface 57 of the tang 17 and the round surface 33 of the tang 18, which causes the two parts to be braced against each other.

It is important here that the tang 17 has not only an upper wedge surface 57 but also lateral wedge surfaces 59 that ensure centering of the top section with the tang 17 with respect to the fixed bottom section 4 during assembly.

The forward face side of the tang 17 is thus provided with lateral beveled wedge surfaces 59 that taper toward each other (compare FIG. 19) and that come to rest on associated edges 60 in the area of the opening 24 in the non-centered condition, that is, when there is a lateral shift of the top section 6 with respect to the bottom section 4.

Figure 10:
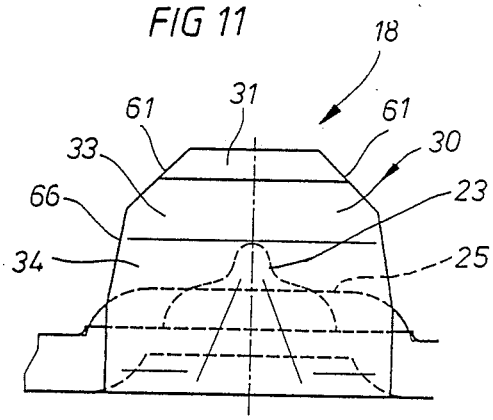
FIG. 10: View Z according to FIG. 9.

It is pointed out at the same time that the tang 18 with its tang head 30 has corresponding lateral beveled edges 61 (compare FIG. 10) so that these edges 61 also come to rest on the associated edges at the opening 36 in the top section 6 when there is a corresponding lateral shift of these sections 4,6 with respect to each other resulting in a centering here as well.

The mutual centering of the sections mentioned is explained in more detail using FIG. 20 to 27.

The engagement of the tang 17 of the top section 6 with the tang 18 of the bottom section is shown in different motion phases for the case of a center offset as represented with position 62 in FIG. 21. It can be seen that a center offset between the tangs 17 and 18 can occur with a shift of the top section 6 in the direction of the arrow 63, that is, toward the end away from the door, and that then the edges 61 of the tang 18 are pre-centered on the associated edges 63 of the adjusting plate 58, which will already cause a motion here of the top section 6 in the direction of the center longitudinal axis (FIG. 21).

With the further shift of the top section 6 in the direction of the arrow 63 according to FIG. 23 and simultaneous tilting of this top section, the forward edge of the tang 17 comes to rest on the associated rounded surfaces 33 of the tang 18.

It is now important that, according to FIG. 23, the beveled lateral edge 61 on the head 30 of the tang 18 comes to rest on the edges of the opening 36 in the top section 6, thereby causing further centering in the direction of the longitudinal center axis of the top section 6.

FIG. 24 shows the engagement of the two tangs 17 and 18 with the top section 6 still tilted slightly.

It is essential here, according to FIG. 23, that the tang 18 now lies in a form-fitting way with its beveled edges 61 on the edges 65 of the opening 36 (compare FIG. 18).

The remainder of the centering is achieved through the slightly beveled wedge surfaces 61 (compare FIG. 10) that join in the angle behind the edges 61. This centering is shown in FIG. 23.

The previously shifted center lines are then centered, that is, there is a centered assembly of top section and bottom section as shown in FIG. 25 with the plates in precise superposition and the rotary slider 7 arranged at the end away for the door can then be closed.

The precise flush mating of these two section 4,6 is shown in FIG. 26 and 27.

The special guidance system and centering of associated parts gives the particular advantage that the invented hinge can be mounted together with other hinges that are already securely fastened to the door part and the furniture part and that centering of the hinge not yet mounted can still be carried out with uniform distribution of force to the hinges in parallel arrangement.

FIG. 28 to 31 show the assembly case described where a number of hinges are already securely arranged between the door part and the furniture part and only one remaining hinge is to be mounted, that is a snap-on between the top section and the bottom section is to be carried out.

It is not possible here to carry out the snap-on in the direction of motion described in FIG. 4. Here, the top section 6 is guided almost parallel to the bottom section 4, which means approximately vertical placement of the top section 6 on the bottom section 4 in the direction of the arrow 67.

Figure 29:
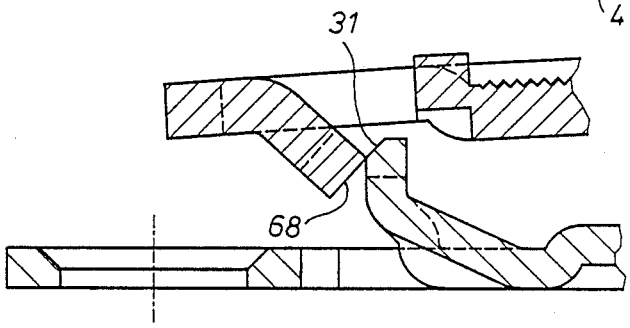
Figure 30:
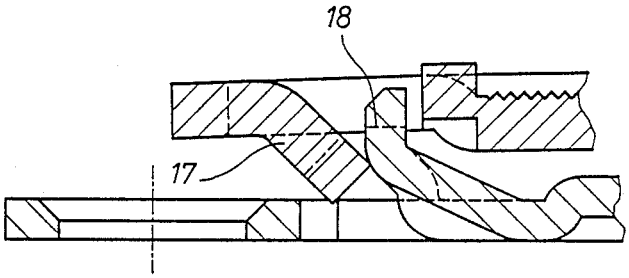

The tang 17 with its forward face side 68 on the wedge surface 31 then comes to rest on the face side of the tang head 30 of the tang 18 with a relative shift between the surfaces 68 and 31 associated with each other, as is represented in FIG. 29. Since the already mounted hinges have a certain amount of flexibility depending on dimensions, the required relative motion between the surfaces 31, 68 according to FIG. 29 will take place, so that it is possible in this assembly case as well to bring the tang 17 as required under the tang 18 with the beveled surfaces 31 and 68 providing the necessary force.

Figure 31:
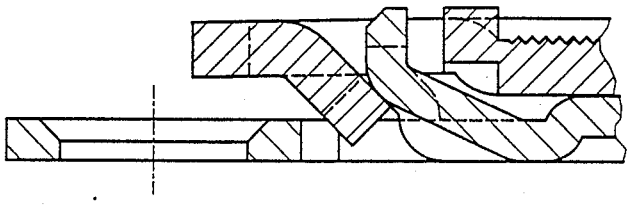

The previously described assembly is then achieved as represented in FIG. 31.

The advantages of the hinge design according to the invention are summarized below.

An essential advantage of the invention is that use is made of a two-part mounting plate, that is, one consisting of a mounting plate bottom section and a mounting plate top section, so that is is possible to provide any conventional hinges consisting in a way know per se of a hinge arm, an adjusting plate and an intermediate plate with an engagement system according to the invention without the need for making any changes in the hinge arm, the adjusting plate or the intermediate plate.

Hinges known up to now always had to be provided with closure connections on the hinge arm, which led to the disadvantage that these hinges had to be completely redesigned. This is avoided with the present invention.

Another advantage of the present invention is that the closure connection according to the invention is secure from unintentional opening and can be opened only with a tool. A connection that is self-locking due to the force of the spring 9 and that stabilizes during load transfer is achieved through the arrangement of the excentric surfaces 51 at the underside of the legs 48, 49 of the rotary slider.

It is possible, of course, to swivel the rotary slider in its open position not only by introducing a tool 11 into the intermediate space 13 between the hinge arm and the mounting plate bottom section 4. It would also be possible to arrange a window, for example, in the rotary slider 7. The tool could be inserted into this window to turn the rotary slider 7 in its open position.

Turning by hand is not desired in this case. Another important advantage of the invention is that a tool is not required for closure of the connection according to the invention because the tangs 19*a* effect an automatic swivel of the rotary slider 7 into its opening position against the force of the spring 9 and, when the parts are correctly positioned with respect to each other through the centering described, the rotary slider 7 will automatically snap back in its closing position under the force of the spring 9, which causes force-locking of the excentric surfaces 51 on the associated surfaces of the tangs 19.

The described centering thus makes it possible to snap on a further hinge after hinges have already been mounted, because the described wedge surfaces and beveled edges automatically provide the forces necessary for centering.

The described stopping of the rotary slider in the open position considerably facilitates snap-on of the hinges.

With the described two-part design, that is, division of the mounting plate into a bottom section and a top section, it is possible to supply the hinge frame arm with a preassembled mounting plate top section 6. This mounting plate top section can be supplied not only in a pre-assembled middle position but also with a preassembled lateral depth or side adjustment, which is changed in the factory to suit the application, and the item is shipped pre-assembled and ready for installation.

These already pre-adjusted positions of the mounting plate top section are retained with any disassembly and do not need to be readjusted. This is an important advantage over known hinges that provide the closure connection, for example, between the hinge frame arm and a base plate with the result that, when the closure connection is broken, the adjustments once set must be changed and readjustments must be carried out after assembly.

DRAWING SYMBOLS

1 Door part
2 Hinge arm
3 Furniture part
4 Mounting plate bottom section
5 Fastening screws
6 Mounting plate top section
7 Rotary slider
8 Pin (shaft)
9 Spring
10 Tang
11 Tool
12 Direction of arrow
13 Intermediate source
14 Direction of arrow
14*a* Direction of arrow
15 Direction of arrow
16 Direction of arrow
17 Tang (top section 6), rear
18 Tang (bottom section 4), rear
19 Tang (top section 6), forward
19*a* Tang
20 Opening (bottom section 4), forward
21 Leg
22 Bore
23 Crease
24 Opening (bottom section 4)
25 Elevation
26 Leg
27 Receiving chamber
28 Bore
29 Centering
30 Tang head

31 Wedge surface
32 Angle
33 Rounded surface
34 Straight partial surface
35 Crease
36 Opening (top section 6)
37 Elevation
38 Depression
39 Corrugation
40 Stop
41 Wedge surface
42 Wedge surface
43 Opening
44 Wedge surface
45 Top side
46 Face side
47 Surface
48 Leg
49 Leg
50 Face
51 Excentric surface
52 Forward edge
53 Rear edge
54 Crease
55 Nub
56 Direction of arrow
57 Wedge surface
58 Adjusting plate
59 Wedge surface
60 Edge
61 Edge
62 Position
63 Edge (adjusting plate 58)
64 Longitudinal center axis
65 Edge (Opening 36)
66 Wedge surface (Tang 18)
67 Direction of arrow
68 Face side (Tang 17)
69 Excentric surface (rotary slider 7)
70 Edge (bottom section 4)

What is claimed is:

1. A rapidly mountable furniture hinge associated with a housing carried by a door and fastenable to a furniture part, said hinge comprising: a mounting plate secured to the furniture part having a fitting connection formed therein; a hinge arm moveably connected to the housing; a mounting plate top section adjustably securd to said hinge arm having a tang at one end directly downwardly at an angle away from the door for engagement with said mounting plate fitting connection and a plurality of tangs at the other end directed downwardly at angles away from the door; and a rotary slider moveably affixed to said mounting plate proximate the furniture part having a spring contiguous thereto and a forward inclined locking edge inclined in a direction opposite to the direction of inclination of the plurality of tangs engageable with said plurality of tangs to secure said mounting plate to said mounting plate top section as said spring urges to locking edge and said plurality of tangs in a locking relationship, said mounting plate top section tang and said mounting plate fitting connection releasably engaging each other when said slider locking edge engages said plurality of tangs to form a hinge snap closure.

2. The hinge as claimed in claim 1 wherein the rotary slider is positioned on the mounting plate end away from the door.

3. The hinge as claimed in claim 1 wherein the fitting connection is an angled tang involved an approximately vertical tang head with a wedge surface along the tang head front surface and a lower rounded off surface.

4. The hinge as claimed 3 wherein the upper surface of the mounting plate top section tang engages the fitting connection tang rounded off surface when the hinge is in the locked position.

5. The hinge as claimed in claim 4 wherein the mounting plate has two parallel legs formed at the end away from the door with a space between them within which the rotary slider pivots.

6. The hinge as claimed in claim 5 wherein two of the plurality of tangs in the mounting plate top section are directed at an angle to engage the rotary slider locking edge.

* * * * *